US005105988A

United States Patent [19]

Knickerbocker

[11] Patent Number: 5,105,988

[45] Date of Patent: Apr. 21, 1992

[54] PROTECTOR CAP AND WIPER FOR DISPENSER DISCHARGE ORIFICE

[75] Inventor: Michael G. Knickerbocker, Upland, Calif.

[73] Assignee: Calmar Inc., Watchung, N.J.

[21] Appl. No.: 538,735

[22] Filed: Jun. 15, 1990

[51] Int. Cl.[5] ..... B67D 5/00

[52] U.S. Cl. ..... 222/148; 222/321; 222/517; 239/115

[58] Field of Search ..... 222/148, 149, 182, 321, 222/342, 380, 387, 402.12, 402.13, 402.1, 513, 517, 545, 556, 562; 215/235, 236; 239/115, 123

[56] References Cited

U.S. PATENT DOCUMENTS

| | | | |
|---|---|---|---|
| 3,154,224 | 10/1964 | Wakeman | 222/402.12 |
| 3,155,291 | 11/1964 | Wakeman | 222/506 |
| 3,245,588 | 4/1966 | Sagarin | 222/182 |
| 3,484,023 | 12/1969 | Meshberg | 222/402.11 |
| 3,642,179 | 2/1972 | Micallef | 222/402.12 |
| 3,759,431 | 9/1973 | Vos | 222/517 |
| 4,821,926 | 4/1989 | Battegazzore | 222/380 |
| 4,915,268 | 4/1990 | Lay et al. | 222/556 |

FOREIGN PATENT DOCUMENTS

| | | | |
|---|---|---|---|
| 1086081 | 2/1955 | France | 222/556 |
| 1179304 | 1/1970 | United Kingdom | 222/402.12 |

*Primary Examiner*—Michael S. Huppert
*Assistant Examiner*—Philippe Derakshani
*Attorney, Agent, or Firm*—Watson, Cole, Grindle & Watson

[57] ABSTRACT

The finger actuated plunger of a dispenser has a protector cap pivotally mounted thereon and normally disposed for covering the discharge orifice. The cap is pivotally movable relative to the head upon application of finger force to the cap in the direction of plunger head reciprocation for uncovering the orifice. The cap is resiliently urged into its normal orifice-covering position upon removal of the applied finger force.

13 Claims, 1 Drawing Sheet

PROTECTOR CAP AND WIPER FOR DISPENSER DISCHARGE ORIFICE

BACKGROUND OF THE INVENTION

This invention relates generally to a manually operated dispenser having a reciprocable plunger head containing a discharge orifice through which product is dispensed upon head reciprocation. More particularly, the invention relates to a protector cap pivotally mounted on the plunger head, normally covering the discharge orifice during non-use, and automatically uncovering the orifice at the initiation of manual reciprocation of the head.

Manually actuated pump dispensers are well known for dispensing a variety of products upon finger actuation of a plunger head which reciprocates the pump piston traveling within a pump cylinder for pressurizing the product and discharging it through a discharge passage located in the head which terminates in a discharge orifice. The products to be dispensed, as by spraying, include hair sprays and other resinous containing materials which, upon drying, upon exposure to the atmosphere, tend to clog the spray discharge orifice. Clogging interferes with the free flow of discharge by causing sputtering and uneven spray patterns.

Protector caps and covers have been devised to prevent the drying out of the discharged material in the discharge spout or orifice and to prevent its contamination. The known caps and covers employed for this purpose are, however, rather cumbersome, difficult to operate, and are costly to fabricate. Moreover, they are so structured as to render them unwieldy and unattractive.

SUMMARY OF THE INVENTION

It is an object of the present invention to provide a protector cap for the discharge orifice of a manually reciprocable plunger head of a manually operated dispenser, the cap being pivotally mounted on the head for rocking movement and normally covering the discharge orifice. The cap is pivotally movable relative to the head upon application of finger force to the cap in the direction of plunger head reciprocation for uncovering the orifice. The cap contains resilient means for urging it into its normal orifice-covering position upon removal of the applied finger force.

The cap forms a smooth extension of the plunger head, is easily assembled, of simple construction which is easy to fabricate, and is simple to use.

In one version of the invention, the cap is apertured such that when pivoted to uncover the orifice, the aperture is aligned with the orifice during use. In another version, the cap annular wall clears the orifice upon pivoting the cap from its orifice-closing position.

In both versions, a spring is employed for both resiliently urging the cap into its normal orifice-closing position, and for pivotally mounting the cap on the plunger head.

The upper portion of the cylindrical wall of the head has an annular external recess for receiving the annular wall of the cap, such that the outer diameter of the cap annular wall is substantially flush with the outermost diameter of the head cylindrical wall.

Furthermore, the cap annular wall has an internal projection in alignment with the orifice in the covering position for wiping the orifice clean when uncovered in the event of any accumulation of dry product at the orifice.

Other objects, advantages and novel features of the invention will become more apparent from the following detailed description of the invention when taken in conjunction with the accompanying drawings.

DETAILED DESCRIPTION OF THE INVENTION

Figure 2:
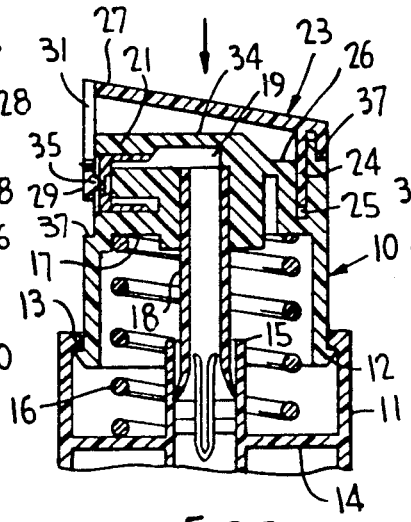
FIG. 2 is a view taken substantially along the line 2—2 of FIG. 1 with the plunger head shown mounted on the upper portion of a pump body shown in section.

Turning now to the drawings wherein like reference characters refer to like and corresponding parts throughout the several views, a plunger head 10 for a finger actuated pump sprayer is shown in FIG. 2 as typically mounted on a pump dispenser body 11, cooperating retention beads 12 and 13 respectively on the head and the body cooperating in a known manner to prevent separation of the parts. The body has an upper transverse wall 14 supporting a fixed cylinder 15 in communication with a valved inlet (not shown) from which a dip tube (not shown) extends into the product within the container (not shown) to which body 11 is mounted as in a known manner.

A return spring 16 acts between wall 14 and an undersurface 17 of the head, and a hollow piston 18 depends from the head for reciprocation within the pump cylinder. A discharge passage 19 communicates with the hollow piston, and a valve cup 21 is mounted within the head in communication with the discharge passage. The discharge passage terminates in a discharge orifice 22 located in the valve cup. Thus, upon manual reciprocation of the plunger head along its central axis, product is discharged during each compression stroke through the discharge orifice, as known in the art.

A protector cap 23 of the invention is pivotally mounted on the plunger head, such as by means of a depending plate spring 24 received within a slot 25 located in the upper surface 26 of the plunger head.

Figure 1:
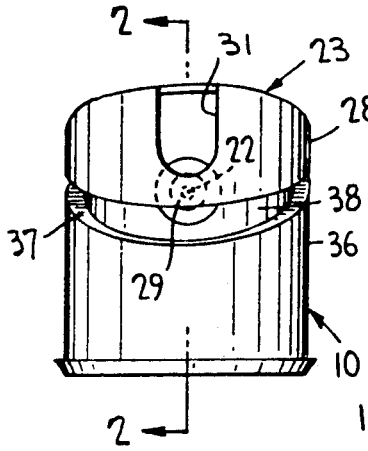
FIG. 1 is a front elevational view of one embodiment to the invention, showing the protector cap pivotally mounted on a dispenser plunger head.

The cap has an upper wall 27 forming a bearing surface for the finger of the operator in a manner to be more fully described hereinafter. An annular wall 28 depends from wall 27 and, as seen in FIGS. 1 and 2, has a wall portion 29 covering the discharge orifice in the normal position of the cap.

The cap is apertured as at 31 in vertical alignment with discharge orifice 22.

In addition to or in lieu of plate spring 24, an upstanding plate spring 32 may be provided on plunger head 10 adjacent spring 24 and extending into a slot 33 located in the underside of the cap.

Figure 3:
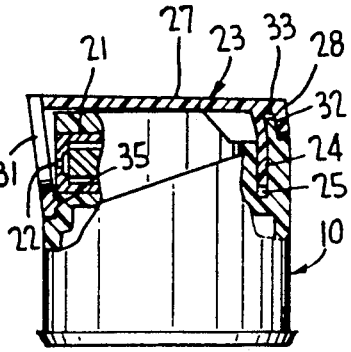
FIG. 3 is a view similar to FIG. 2, showing the discharge orifice uncovered during use.
Figure 4:
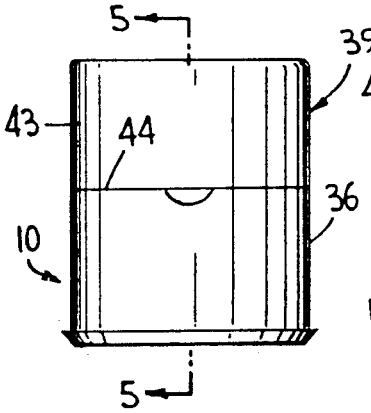
FIG. 4 is a front elevational view of another embodiment of the invention showing the protector cap pivotally mounted on a dispenser plunger head.

In operation, application of finger force against upper wall 27 of the protector cap, in the direction of the arrow of FIG. 2, pivotally moves the cap downwardly with spring 24 and/or spring 32 acting as a pivot. At the same time, aperture 31 in the cap is moved into alignment with discharge orifice 22 for thereby uncovering the orifice. Continued application of the finger force applied to the cap, in the direction of plunger reciprocation, depressses the plunger head relative to dispenser body 11 to effect the spray discharge of product through the uncovered discharge orifice and the aligned aperture 31, as illustrated in FIG. 3. The slight spacing between upper wall 27 and uppermost surface 34 of the plunger head facilitates pivotal movement of the cap from its FIG. 2 to its FIG. 3 position as wall 27 is brought to substantially bear against surface 34.

When the desired amount of product has been dispensed upon each pressure stroke of the plunger, the applied finger force is removed, allowing the plunger and the cap to return to the upwardly extended position of the plunger shown in Figure 2, as assisted by return spring 16, as known in the art. Removal of the applied finger force automatically returns the cap to its FIG. 2 position from that of FIG. 3 as resiliently urged by the unbending and flattening of spring 24 and/or spring 32 into the orifice-covering position of FIG. 2.

In the orifice-covered position of FIG. 2, the orifice is closed to the atmosphere, thereby avoiding possible clogging of discharge passage 19 and of discharge orifice 22 during especially prolonged periods of non-use of the dispenser. Such prolonged exposure to air would otherwise adversely affect the quality of the discharge or other physical characteristics.

In accordance with another feature of the invention, any accumulation of dried product at or in the discharge orifice is removed and is further prevented by the provision of a small projection 35 on the inner surface of annular wall 28 of the cap. As shown in FIG. 2, this projection is in alignment with the discharge orifice and may slightly project into the orifice in the orifice-covering position. Upon downward pivotal movement of the cap to the FIG. 3 position, the projection simply wipes the orifice and its vicinity clean while removing any dried product as may have accumulated.

As seen in FIGS. 1 and 2, the overall size of the cap is essentially the same as that of the plunger head, giving a neat and attractive appearance and avoiding the appearance of an otherwise unsightly oversized cap. For this purpose, cylindrical wall 36 of the plunger is cut away as at 37 along a plane inclined relative to the central axis of the head. An external annular recess 38 is thus formed of a depth essentially equal to the thickness of annular wall 28 of the cap. The outer diameter of wall 28 is therefore substantially flush with the major diameter of cylindrical wall 36, while recess 38 permits the cap to pivotally move to its FIG. 3 position without interference.

Another embodiment of the invention is illustrated in FIGS. 4 to 7, in which a protector cap 39 is pivotally mounted on plunger head 10 for rearward rocking movement into an orifice-uncovered position compare to the forward rocking movement of FIGS. 1 to 3.

Plunger head 10 of FIGS. 4 to 7 is essentially the same as that of FIGS. 1 to 3 for mounting on body 11, except for the upper external recess formed thereon to accommodate cap 39.

Protector cap 39 is pivotally mounted on the plunger head by the provision of a pair of spaced plate springs 41 received within corresponding slots 42 located in the upper surface of the head. Annular wall 43 of the cap covers the discharge orifice in the FIG. 5 position for closing the discharge to the atmosphere to avoid drying of product during especially prolonged periods of non-use, which may cause orifice clogging. Upon application of finger force, along the arrow of FIG. 5, in the direction of plunger reciprocation, the cap pivots at springs 41 by rocking rearwardly such that its annular wall 43 uncovers the discharge orifice to permit discharge through an unclogged orifice during each pressure stroke of the plunger. Removal of the applied finger force returns cap 39 to its FIG. 5 position as resiliently urged by the unbending of springs 41.

Annular wall 36 of the plunger head is cut away as at 44 so as to provide an annular recess 45 at the upper portion thereof of a depth substantially equal to the thickness of annular wall 43. The cutaway section lies in a transverse plane through approximately 180° of the plunger head, and inclines downwardly therefrom,, as seen in FIGS. 5 and 6, to accommodate the rearward rocking motion of the cap without interference.

It should be pointed out that the spring force of the resilient means employed for both embodiments must be less than the force required to depress the plunger against the combined action of return spring 16 and the hydraulic pressure in the pump chamber of the dispenser. This assures that the protector cap will be pivoted to its orifice-uncovered position momentarily before plunger depression such that the discharge orifice is uncovered before product issues from the discharge orifice.

Figure 5:
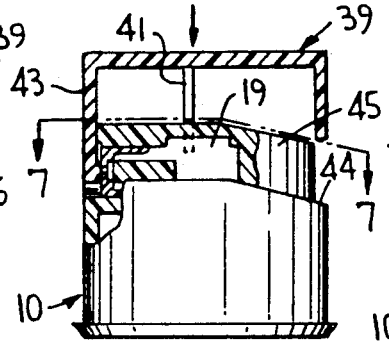
FIG. 5 is a view taken substantially along the line 5—5 of FIG. 4, partly in section.
Figure 6:
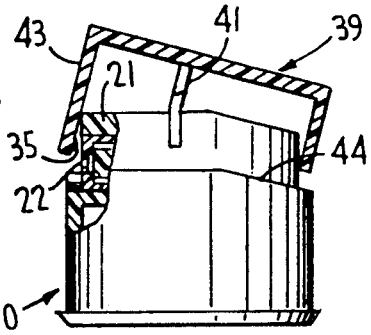
FIG. 6 is a view similar to FIG. 5 showing the discharge orifice uncovered during use.
Figure 7:
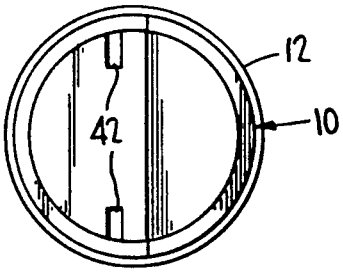
FIG. 7 is a top plan view of the plunger head, with the protector cap removed, taken substantially along the line 7—7 of FIG. 5.

And, the aperture-free protector cap of the FIGS. 4 to 7 embodiment likewise has a projection 37 seated in or at the discharge orifice in the FIG. 5 closing position for assuring a clog-free orifice and for wiping the orifice and its vicinity of any accumulated dried product as the cap is pivotally moved to and from its FIG. 6 position.

Moreover, it can be seen that the plate springs of both embodiments lie within the confines of the protector caps, i.e., spaced inwardly of the annular wall thereof. This tends to further improve upon the appearance of the cap/plunger head assembly.

And, although both embodiments have been described with reference to plate springs, other resilient means can be employed without departing from the scope of the invention.

Operation of the protector cap of the invention requires no special instructions for the user. Consequently, neither the plunger nor the cap need be marked with indicia to acquaint the user for its operation. Finger force is simply applied to the upper surface of the protector cap as in any other finger actuated dispenser. The cap is automatically rocked forwardly or rearwardly prior to plunger depression for uncovering the orifice without even an awareness by the operator. And, each time the finger force is removed, dispensing terminates during each suction stroke and the orifice is automatically again covered.

Moreover, the protector cap in both embodiments forms an essentially smooth extension of the plunger head so as to improve upon the overall appearance.

Obviously, many modifications and variations of the present invention are made possible in the light of the above teachings. It is therefore to be understood that within the scope of the appended claims the invention may be practiced otherwise than as specifically described.

What is claimed is:

1. A manually operated dispenser having a plunger head reciprocable along a central axis thereof, said head having a cylindrical wall containing a discharge orifice through which product is dispensable upon head reciprocation, a protector cap pivotally mounted on said plunger head, said cap having a lower wall portion for covering said orifice in a condition of non-use, said cap having an aperture adjacent said wall portion for alignment with said orifice for uncovering said orifice in a condition of use, said cap being pivotally movable relative to said head between said conditions of non-use and use upon application of finger force to said cap in the direction of head reciprocation for covering and uncovering said orifice, and means for urging said cap to said condition of non-use orifice-covering upon removal of the applied finger force.

2. The dispenser according to claim 1, wherein said means comprises a spring for also pivotally mounting said cap on said head.

3. The dispenser according to claim 2, wherein said spring comprises a plate spring.

4. The dispenser according to claim 1, wherein said cap has an annular wall containing said wall portion and said aperture, said annular wall having an outer diameter substantially flush with the outer diameter of said cylindrical wall.

5. The dispenser according to claim 4, wherein said means is spaced inwardly of said annular wall.

6. The dispenser according to claim 2 wherein said cap has an annular wall containing said wall portion of said aperture, said spring being spaced inwardly of said annular wall.

7. The dispenser according to claim 1, wherein said cap is provided with an internal projection in contact engagement with said orifice in said condition of non-use.

8. The dispenser according to claim 4, wherein said cap has an annular wall containing said wall portion and said aperture, an upper portion of said cylindrical wall having an annular external means for receiving said annular wall.

9. A manually operated dispenser having a plunger head reciprocable along a central axis thereof, said head having a cylindrical wall containing a discharge orifice through which product is dispensable upon head reciprocation, a protector cap pivotally mounted on said plunger head and normally disposed for covering said orifice, said cap being pivotally movable relative to said head upon application of finger force to said cap in the direction of head reciprocation for uncovering said orifice, said cap having an annular wall of an outer diameter substantially flush with the outer diameter of said cylindrical wall, and means inwardly spaced from said annular wall for urging said cap into its normal orifice-covering position upon removal of the applied finger force.

10. The dispenser according to claim 9, wherein said means comprises a spring for also pivotally mounting said cap on said head.

11. The dispenser according to claim 10, wherein said spring comprises a plate spring.

12. The dispenser according to claim 9, wherein said annular wall has an internal projection in contact engagement with said orifice in said covering position.

13. The dispenser according to claim 9, wherein an upper portion of said cylindrical wall has an annular external recess for receiving said annular wall.

* * * * *